US005092984A

United States Patent [19]

Babu et al.

[11] Patent Number: 5,092,984

[45] Date of Patent: Mar. 3, 1992

[54] PYROLYSIS OF COAL

[75] Inventors: Suresh P. Babu, Willow Springs; Wilford G. Bair, Morton Grove, both of Ill.

[73] Assignee: Institute of Gas Technology, Chicago, Ill.

[21] Appl. No.: 459,209

[22] Filed: Dec. 29, 1989

[51] Int. Cl.[5] ..... C10G 1/02; C10B 49/10

[52] U.S. Cl. ..... 208/409; 48/210; 201/8; 201/31; 208/426

[58] Field of Search ..... 201/31, 8, 7; 208/409, 208/410, 426, 427; 48/210, DIG. 4

[56] References Cited

U.S. PATENT DOCUMENTS

| | | | |
|---|---|---|---|
| 2,339,932 | 1/1944 | Kuhl | 201/31 |
| 2,534,051 | 12/1950 | Nelson | 201/31 |
| 2,534,728 | 12/1950 | Nelson et al. | 201/31 |
| 2,582,711 | 1/1952 | Nelson | 208/410 |
| 2,582,712 | 1/1952 | Howard | 201/31 |
| 2,606,145 | 8/1952 | Creelman | 208/409 |
| 2,608,526 | 8/1952 | Rex | 201/31 |
| 2,610,944 | 9/1952 | Hemminger | 201/31 |
| 2,619,401 | 11/1952 | Ogorzaly et al. | 201/31 |
| 2,719,112 | 9/1955 | Kearby et al. | 201/31 |
| 3,454,383 | 7/1969 | Pirsh et al. | 48/101 |
| 3,960,700 | 6/1976 | Rosen et al. . | |
| 4,017,272 | 4/1977 | Anwer et al. | 201/31 |
| 4,052,172 | 10/1977 | Shirakawa et al. | 201/31 |
| 4,057,402 | 11/1977 | Patel et al. | 201/31 |
| 4,146,370 | 3/1979 | Herwijnen et al. | 201/31 |
| 4,200,438 | 4/1980 | Kaimann et al. | 201/31 |
| 4,331,529 | 5/1982 | Lambert et al. . | |
| 4,347,064 | 8/1982 | Reh et al. | 201/31 |
| 4,359,363 | 11/1982 | Durai-Swamy | 201/31 |
| 4,531,949 | 7/1985 | Koyama et al. | 48/DIG. 4 |
| 4,699,632 | 10/1987 | Babu et al. | 48/197 R |
| 4,721,514 | 1/1988 | Kikuchi et al. . | |
| 4,891,459 | 1/1990 | Knight et al. | 201/8 |

*Primary Examiner*—Peter Kratz

*Attorney, Agent, or Firm*—Speckman & Pauley

[57] ABSTRACT

A method for mild gasification of crushed coal in a single vertical elongated reaction vessel providing a fluidized bed reaction zone, a freeboard reaction zone, and an entrained reaction zone within the single vessel. Feed coal and gas may be fed separately to each of these reaction zones to provide different reaction temperatures and conditions in each reaction zone. The reactor and process of this invention provides for the complete utilization of a coal supply for gasification including utilization of caking and non-caking or agglomerating feeds in the same reactor. The products may be adjusted to provide significantly greater product economic value, especially with respect to desired production of char having high surface area.

22 Claims, 1 Drawing Sheet

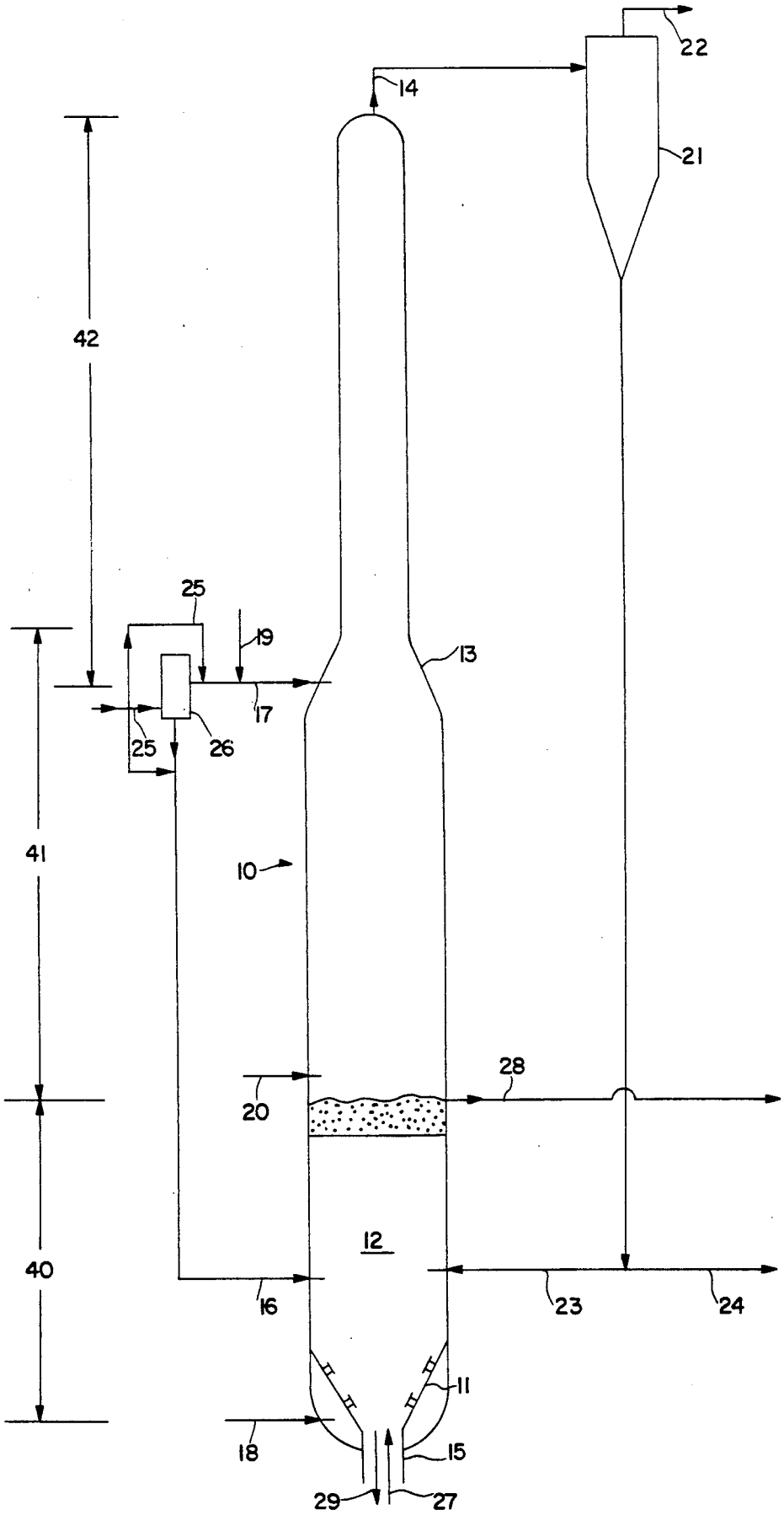
22
14
21
42
25
19
13
17
25
26
41
10
28
20
12
40
16
23
24
11
18
15
29
27

PYROLYSIS OF COAL

The U.S. Government has a paid-up license in this invention and rights as provided for by the terms of contract No. DE-AC21-87MC24266 awarded by the U.S. Department of Energy.

BACKGROUND OF THE INVENTION

1. Field of the Invention

The present invention relates to pyrolysis or mild gasification of coal and an apparatus suitable for conversion of both caking and non-caking coals. The process and apparatus of this invention provides selectivity of desired products with high yields of aromatic oils and tars and reactive char.

2. Description of the Prior Art

U.S. Pat. No. 4,331,529 teaches a coking and gasification process wherein carbonaceous feed stock, such as hydrocarbon liquids or coals, are introduced to a fluidized bed coking zone producing vapor phase products, including normally liquid hydrocarbons, and coke which is deposited on fluidized solids. The coke and fluidized solids are then passed through a heater to a first fluidized bed gasification zone where a portion of the coke is reacted with an oxygen containing gas to produce gaseous products and partially gasified coke. A portion of the partially gasified hot coke is then passed to a second fluidized bed gasification zone and reacted with steam to produce hydrogen and carbon monoxide. Thermal energy is transferred to the first fluidized bed gasification zone by recirculating a portion of the partially gasified coke deposited on the fluidized bed solids, such as silica or alumina from the second gasification zone.

U.S. Pat. No. 4,721,514 teaches a coal gasification process of injecting raw coal powder with oxygen or air and steam into a fluidized bed reaction chamber and reacting the coal, steam and oxygen under gasification conditions producing gas, char and ash. The '514 patent further teaches agglomerating the ash product produced in the fluidized bed to attain ash with a diameter of between 2.5 mm and 10 mm, causing it to drop from the reaction chamber through a throat against a gas stream into a combustion chamber. The char and injected coal is combusted in the combustion chamber to produce hot fluidizing gas to establish and maintain the fluidized bed gasification conditions in the reaction chamber. The agglomerated ash is fused during combustion and withdrawn from the combustion chamber.

U.S. Pat. No. 3,960,700 teaches adding crushed coal and hot hydrogen into the upper portion of a reactor for rapid heating of the coal. The coal and hot hydrogen reacts at 400° to 2000° C. and at pressures ranging from 500 to 5000 psig followed by rapid quenching so that the total residence time is less than 2 seconds. U.S. Pat. No. 4,012,311 teaches a process for hydropyrolysis of coal requiring at least two serially oriented reaction zones. Coal and hot hydrogen is fed to a first reaction zone at the upper portion of a reactor maintained at a pressure less than 450 psia and a temperature of 400° to 2000° C. with shock quenching with hydrogen below 0° C. and a total residence time less than 2 seconds. Residual carbonaceous material is introduced into a subsequent reaction zone and the same process repeated.

The first two above mentioned patents refer to high pressure hydropyrolysis or staged fluidized bed pyrolysis using air as an oxidant while the last two patents refer to hydropyrolysis processes designed to directly produce high quality, low boiling aromatics, primarily benzene. The byproduct fuel gas and char are used primarily to supply hydrogen and process energy. None of these patents suggest any processes or apparatus having the ability to control the products produced, especially low boiling aromatics and high surface area char.

SUMMARY OF THE INVENTION

This invention provides an apparatus for pyrolysis or mild gasification, as compared to prior art processes, of crushed coal in a single vertical elongated reaction vessel having a fluidized bed support means in its lower portion for support of a fluidized bed and a necking region spaced above the fluidized bed to form a freeboard reaction zone between the top of the fluidized bed and the necking region and to form an entrained reaction zone above the necking region. Gaseous product withdrawal means are located at the upper portion of the entrained reaction zone and solid char withdrawal means are located in the lower region of the fluidized bed support means. Coal feed means are provided to the fluidized bed and to the necking region. The coal feed means may comprise a size separation means capable of separating the coal feed into a fines component having a maximum particle size of about 1/32nd inch and a coarse component having a maximum particle size of about ⅛th inch with a fines feeding means feeding to the necking region and a coarse feeding means feeding to the fluidized bed. For severely agglomerating coals, coal feed means to the fluidized bed may comprise char recycle and/or coal feed means directing feed coal upwardly through the solid char withdrawal means forming a turbulent spouting bed. When the turbulent spouting bed is used, a second char withdrawal means may be provided in the upper portion of the fluidized bed. Thus, coal may be fed unsized to the upper portion of the freeboard zone and/or directly to the fluidized bed, size graded coal may have fines fed to the upper portion of the freeboard zone and the coarse fraction fed to the fluidized bed, or agglomerating coals may be fed to the lower portion of the fluidized bed to form a spouting bed region. Fluidizing gas feed means are provided below the fluidized bed support means. The reaction vessel may further comprise an entraining gas feed means in the lower region of the entrained reaction zone separate from or feeding into the necking region feed means and a supplemental gas feed means in the lower region of the freeboard reaction zone. The gaseous product withdrawal means may further comprise a gas/solids separator for separating char solids from gaseous product and means for recycling the separated char to the fluidized bed.

An important distinction of the apparatus of this invention from the prior art is provision of three different types of reaction zones within a single reaction vessel to which supply of feed and gas may be separately controlled in manners to be more fully explained herein. The apparatus and process of this invention provides utilization in one reactor of all types and sizes of coal particles. The apparatus and process directly utilizes both coarse and fine sizes of coal enabling use of the entire coal supply available in a single reactor and process. Conventional crushing and coal recovery techniques result in an appreciable amount of fines with high moisture content. These fines can be economically dewatered by using the surplus process heat and can then be directly utilized in the mild gasification process.

The process for mild gasification of coal according to this invention comprises introducing coal feed particles having an average particle size of less than about ⅝th inch to a single vertical elongated reaction vessel having a fluidized bed reaction zone in its lower portion, a freeboard reaction zone in its central portion, and an entrained reaction zone in its upper portion. Fluidizing gas is introduced below the fluidized bed reaction zone to maintain the fluidized bed in fluidized condition. The particles in the reaction vessel are heated and maintained at about 1000° to about 1500° F. and under reducing chemical conditions. Gaseous products are removed from the upper portion of the entrained reaction zone and solid products are removed from the fluidized bed reaction zone. Coal particles are maintained in the fluidized bed reaction zone for about 5 to about 60 minutes, preferably about 5 to about 10 minutes. Preferably, fluidizing gas principally comprises gas selected from the group consisting of hot flue gases, recycled product gases, steam, $CO_2$ rich gases, air and mixtures thereof, and may be preheated to temperatures up to about 2000° F.

In one embodiment at least a major portion, more than about 50 weight percent, of the coal feed particles are fed to the upper portion of the freeboard reaction zone, the coarser of the particles passing downwardly through the freeboard reaction zone to the fluidized bed reaction zone and the finer particles passing upwardly through the entrained reaction zone. In this embodiment, it is preferred to maintain the finer particles in the entrained reaction zone for about 2 to about 5 seconds and to introduce entraining gas to the lower portion of the entrained reaction zone. The entraining gas preferably principally comprises gas selected from the group consisting of hot flue gases, recycled product gases, steam, $CO_2$ rich gases, air, and mixtures thereof and may be preheated to temperatures up to about 2000° F.

In another embodiment, supplemental gas may be introduced to the lower portion of the freeboard reaction zone and preferably comprises gas selected from the same group as those set forth above for the entraining gas and fluidizing gas. The supplemental gas may be preheated to temperatures up to about 2000° F.

In yet another embodiment, coal feed particles may be separated into a coarse fraction having particles sized about −⅝ inch +10 mesh and a fines fraction having particles sized −10 mesh. The coarse fraction may be introduced to the fluidized bed reaction zone and the fines fraction to the lower portion of the entrained reaction zone. Conditions, as described above, may be maintained in the entrained reaction zone wherein the fines fraction is entrained in the upwardly moving gas stream and the coarse fraction is separately treated in the fluidized bed reaction zone. At least a portion of the coarse fraction may be introduced to the upper portion of the freeboard reaction zone and devolatilized prior to entry to the fluidized bed reaction zone.

In another embodiment, when highly agglomerating coals are used as feed in the apparatus and process of this invention, a major portion of the coal feed particles may be introduced to the lower portion of the fluidized bed reaction zone forming a turbulent spouting bed from which solid char particles may be removed in the upper portion of the fluidized bed reaction zone.

The above described reactor and process provides utilization of caking and non-caking coal feeds in the same reactor by variance of the coal feed and gaseous feed locations and further provides desired product selectivity from a single reaction vessel. The single reactor and process of this invention enables utilization of all available coals for gasification including both coarse and fines fractions and high moisture containing fines. These features provide significantly greater product economic value, especially with respect to desired production of char having high surface area.

BRIEF DESCRIPTION OF THE DRAWING

The above objects and advantages of this invention will become further apparent upon reading of the detailed description of preferred embodiments in reference to the drawing wherein:

The FIGURE shows one embodiment of an apparatus suitable for the process of mild gasification of crushed coal according to this invention.

DESCRIPTION OF PREFERRED EMBODIMENTS

Referring to the FIGURE, the apparatus for mild gasification of crushed coal in accordance with this invention is shown in highly stylized form as including single vertical elongated reaction vessel 10. Reaction vessel 10 has fluidized bed support 11 in its lower portion for support of fluidized bed 12 and necking region 13 spaced above fluidized bed 12 to form freeboard reaction zone 41 between the top of fluidized bed reaction zone 40 and necking region 13 and to form entrained reaction zone 42 above necking region 13. Fluidized bed support 11 may be any fluidized bed support as known to the art and is preferably a sloping grid support. Gaseous product withdrawal means 14 is located at the upper portion of entrained reaction zone 42 and solid char withdrawal means 15 is in the lower region of fluidized bed support 11 for withdrawal of solids as indicated by arrow 29. Char withdrawal means may be any solids withdrawal means known to the art for withdrawal of solids from a low pressure reactor, preferably a straight sided conduit, and include appropriate lockhoppers and flow control valving as is well known to the art. Fluidized bed coal feed means 16 is provided to feed coal to fluidized bed 12 and necking region coal feed means 17 is provided to feed coal to necking region 13 in the upper portion of freeboard reaction zone 41 or in the lower portion of entrained reaction zone 42. Coal feed means may be any solids feed means known to the art for feeding solids to a low pressure reactor and include appropriate lockhoppers and flow control valving as is well known to the art. The coal particles may be introduced to the fluidized bed by a combination of screw feeding and entrainment to distribute the entrained coal across the cross-section of necking region 13. Fluidizing gas feed means 18 supplies fluidizing gas below fluidized bed support 11 to maintain fluidized bed 12 in fluidized condition. Entraining gas feed means 19 is located in the lower portion of entrained reaction zone 42 and may feed into necking region coal feed means 17 to entrain the coal feed or may enter the lower portion of entrained reaction zone 42 separate from necking region coal feed means 17. Supplemental gas feed means 20 may be provided in the lower portion of freeboard reaction zone 41. These gas feed means may include suitable pressurizing means, heating means, and flow control valving as known to the art to provide gas flows to obtain reaction conditions desired in the different reaction zones of the reactor. The entraining and supplemental gas feed means may also include any desired distribution means to distribute the gas flow across the cross-section of the reactor and in an upward direction.

Gaseous product withdrawal means 14 may further include gas/solids separator 21 for separating char solids from gaseous product. Any gas/solids separator, such as a cyclonic separator, may be used. Separated gaseous product may be withdrawn through gaseous product conduit 22 and char solids may be recycled through char recycle conduit 23 to fluidized bed 12 or may be withdrawn as product through char product conduit 24.

The coal feed means may comprise unsized coal feed means 25 which may feed directly into necking region coal feed means 17 or directly into fluidized bed coal feed means 16 or may feed to particle size separation means 26 capable of separating the coal feed into a fines fraction having a maximum particle size of about 1/32nd inch for feeding through coal feed means 17 to the lower portion of entrained reaction zone 42 and a coarse fraction having a particle size of about 1/32nd to ⅜th inch for feeding through fluidized bed coal feed means 16. The maximum size coal particle fed to the reactor is about ⅜th inch. Options for feeding coal to the reactor of this invention include feeding coal ungraded for size completely through either or both necking region coal feed means 17 and/or fluidized bed coal feed means 16 or feeding sized coal separately, fines fraction through necking region coal feed means 17 and coarse fraction through fluidized bed coal feed means 16.

For severely agglomerating coals, coal feed means 27 may be provided directing feed coal upwardly through fluidized bed support 11 forming a turbulent spouting-type fluidized bed. In this embodiment, char may be recycled from gas/solids separator to coal feed means 27 and introduced with the agglomerating coal to aid in reducing the agglomerating tendencies. When used in this mode, char withdrawal means 28 is supplied for withdrawal of char from the upper portion of the turbulent spouting bed.

Through use of the apparatus of this invention, as described above, differing process conditions are rendered available in a single reactor to provide highly efficient conversion of both caking and non-caking coals in the production of coal derived co-products. Further, use of the apparatus of this invention provides high utilization of both coarse and fines fractions of coal whether or not separated.

In one embodiment of this invention, unsized coal may be fed through necking region coal feed means 17 into the necking region of the reaction vessel wherein the fines portion passes upwardly through entrained reaction zone 42 and the coarse portion passes through freeboard reaction zone 41 into fluidized bed reaction zone 40. Introduction of coal through necking region coal feed means 17 is especially useful when using caking coals to provide devolatilization of the coarse portion as it passes through freeboard reaction zone 41 and thus the devolatilized coal solids introduced into fluidized bed 12 have less tendency to cake. Temperatures in each of the reaction zones, the fluidized bed reaction zone, the freeboard reaction zone, and the entrained reaction zone, may be separately controlled by any suitable heating means known to the art placed within that zone and/or by temperature control of gas separately introduced to each of the three zones. Fluidizing gas may be introduced beneath fluidized bed support 11 through fluidizing gas feed means 18 in at least sufficient quantity to maintain fluidized bed 12 in fluidized condition. Gases introduced to the reaction zones can be selected from the group consisting of hot flue gases, recycled product gases, steam, $CO_2$ rich gases, air, and mixtures thereof. The fines portion is heated rapidly in entrained reaction zone 42 and maintained at temperatures of about 1000° to 1500° F., preferably about 1100° to about 1300° F., the fines portion of the solids having a residence time within entrained reaction zone 42 of about 1 to about 3 seconds, preferably about 1 to about 2 seconds. Due to the rapid heat up and small particle size, secondary reactions in the entrained reaction zone are reduced, producing primarily high boiling aromatics, naphthalene, anthracene, phenanthrene and pitch which are removed through gaseous product withdrawal means 14. Entraining gas introduced through entraining gas feed means 19 and supplementary gas introduced through supplementary gas feed means 20 control the particle residence time in entrained reaction zone 42 and may be used to control desired high temperatures in entrained reaction zone 42. The coarse fraction free falls through freeboard reaction zone 41 heating the coarse fraction particles to temperatures of about 600° to about 1000° F. before reaching the top of fluidized bed 12. Solids residence time of about 0.5 seconds to about 1.0 seconds of coarse fraction particles in freeboard reaction zone 41, as well as the desired temperature of coarse particles in the freeboard reaction zone, may be controlled by feeding supplemental gas to the lower portion of freeboard reaction zone through supplemental gas feed means 20. In freeboard reaction zone 41, the coal devolatilization products are driven off and after passing through entrained reaction zone 42 exit the reactor at gaseous product withdrawal means 14. The partially devolatilized coal enters fluidized bed 12 which is maintained at temperatures of about 1000° to about 1500° F. for a solids contact time of about 5 to about 60 minutes, preferably about 5 to about 10 minutes, providing adequate time to promote secondary reactions, thus forming low boiling aromatics such as benzene, toluene, xylenes and phenols and high surface area char useful as form-coke, smokeless fuel or as a substitute for active carbon.

In another embodiment of this invention, unsized coal may be fed to size separation means 26 wherein the coal feed particles are separated into a coarse fraction having particles sized about −⅜ inch +10 mesh and a fines fraction having particles sized −10 mesh. The fines portion may then be separately introduced through necking region coal feed means 17 to the lower portion of the entrained reaction zone and the coarse fraction may be separately introduced through fluidized bed coal feed means 16 to fluidized bed 12. In this embodiment, the fines fraction may be entrained in the entraining gas feed stream exterior to reaction vessel 10 and introduced with the entraining gas feed stream through a single feed means. In this embodiment, the coarse fraction feed is not passed through freeboard reaction zone 41 but fed directly to fluidized bed 12 through fluidized bed coal feed means 16. This embodiment is most suitable for known non-caking coal. In this embodiment, the same temperatures and solid residence contact times as described above are suitable with respect to entrained reaction zone 42 and fluidized bed reaction zone 40.

In yet another embodiment, even though the feed coal is sized into a fines fraction and a coarse fraction, the coarse fraction may be separately introduced through necking region coal feed means 17 to provide passage of the coarse fraction through freeboard reaction zone 41 prior to entry into fluidized bed 12. This mode of operation is preferred when caking coals are used and may be conducted under the same conditions as set forth above for feeding the unsized coal directly through necking region coal feed means 17.

In yet another embodiment, severely agglomerating coals may be used in the apparatus and process of this invention by introducing at least a major portion of the coal feed particles through spouting bed coal feed means 27 in fluidized bed support 11 creating a turbulent spouting type fluidized bed by means well known in the art. When the spouting bed embodiment of this process is used, char is withdrawn from the upper portion of fluidized bed reaction zone 40 through char withdrawal means 28. Even when agglomerating types of coal are used, the feed will comprise a fines fraction and a coarse fraction as defined above. When the entire coal feed is introduced through spouting bed coal feed means 27, the fines fraction will pass from fluidized bed 12 upwardly through freeboard reaction zone 41 and entrained reaction zone 42 which may be maintained under higher temperature conditions than fluidized bed 12. Such separate control of temperature and particle contact time in entrained reaction zone 42 may be controlled by entraining gas fed through entraining feed means 19 to promote production of low boiling aromatics and phenols. Similar to the processes described above, the unsized coal may be passed through size separation means 26 and the coarse fraction fed separately to spouting bed coal feed means 27 and the fines fraction fed through necking region coal feed means 17.

In any of the above embodiments, coal feed may be preheated to about 400° to about 450° F. Likewise, sulfur captive additives may be added to coal feed in any of the embodiments to reduce gaseous sulfur output. Hot char may be recycled to the fluidized bed to provide high thermal efficiency and reduction in agglomeration.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A process for pyrolysis of coal comprising:

separating coal feed particles into a coarse fraction having particles sized about $-\frac{5}{8}$ inch $+10$ mesh and a fines fraction having particles sized $-10$ mesh;

introducing said coal feed particles into at least two reaction zones in a single vertical elongated vessel having a fluidized bed reaction zone in its lower portion, a freeboard reaction zone in its central portion, a necking region leading to an entrained reaction zone in its upper portion, said fines fraction introduced to the lower portion of said entrained reaction zone to pass upwardly through said entrained reaction zone producing primarily high boiling aromatics comprising naphthalene, anthracene, phenanthrene and pitch and said coarse fraction introduced directly into said fluidized bed reaction zone and there forming low boiling aromatics comprising benzene, toluene, xylenes and phenols and high surface area char and into the upper portion of said freeboard reaction zone said coarse fraction particles passing downwardly through said freeboard zone forming gaseous devolitilization products which pass upwardly and are removed from the upper portion of said entrained reaction zone and partially devolitilized coal which passes into said fluidized bed reaction zone there forming low boiling aromatics comprising benzene, toluene, xylenes and phenols and high surface area char;

introducing fluidizing gas below said fluidized bed reaction zone;

heating and maintaining said particles in said reaction vessel at about 1000° F. to about 1500° F. and under reducing chemical conditions;

passing gaseous products from said fluidized bed through said freeboard reaction zone into and through said necking region into the lower portion of said entrained reaction zone;

removing products which are gaseous at temperatures of said entrained reaction zone from the upper portion of said entrained reaction zone; and removing products which are solid at temperatures of said fluidized bed reaction zone from said fluidized bed reaction zone.

2. A process according to claim 1 comprising maintaining said particles in said fluidized bed reaction zone for about 5 to about 60 minutes.

3. A process according to claim 1 comprising maintaining said particles in said fluidized bed reaction zone for about 5 to about 10 minutes.

4. A process according to claim 1 wherein said fluidizing gas principally comprises gas selected from the group consisting of hot flue gases, recycled product gases, steam, $CO_2$ rich gases, air, and mixtures thereof.

5. A process according to claim 1 wherein said fluidizing gas is preheated to temperatures up to about 2000° F. exterior to said reaction vessel.

6. A process according to claim 1 comprising separating char solids from said gaseous products and passing said char to said fluidized bed.

7. A process according to claim 1 comprising introducing said coarse fraction directly to said fluidized bed reaction zone there forming low boiling aromatics comprising benzene, toluene, xylenes and phenols and high surface area char.

8. A process according to claim 1 comprising maintaining said coarse fraction particles in said fluidized bed reaction zone for about 5 to about 60 minutes and said fines fraction particles in said entrained reaction zone for about 2 to about 5 seconds.

9. A process according to claim 1 comprising introducing entraining gas to the lower portion of said entrained reaction zone.

10. A process according to claim 9 wherein said entraining gas principally comprises gas selected from the group consisting of hot flue gases, recycled product gases, steam, $CO_2$ rich gases, air, and mixtures thereof.

11. A process according to claim 9 wherein said entraining gas is preheated to temperatures up to about 2000° F. exterior to said reaction vessel.

12. A process according to claim 9 comprising separating char solids from said gaseous products and passing said char solids to said fluidized bed.

13. A process according to claim 10 comprising maintaining said coarse fraction particles in said fluidized bed reaction zone for about 5 to about 60 minutes and said fines fraction particles in said entrained reaction zone for about 2 to about 5 seconds, introducing entraining gas to the lower portion of said entrained reaction zone, and separating char solids from said gaseous products and passing said char solids to said fluidized bed.

14. A process according to claim 1 comprising introducing at least a portion of said coarse fraction to the upper portion of said freeboard reaction zone said coarse fraction particles passing downwardly through said freeboard zone forming gaseous devolitilization products which pass upwardly and are removed from the upper portion of said entrained reaction zone and partially devolitilized coal which passes to said fluidized bed reaction zone there forming low boiling aromatics comprising benzene, toluene, xylenes and phenols and high surface area char.

15. A process according to claim 14 comprising maintaining said coarse fraction particles in said fluidized bed reaction zone for about 5 to about 60 minutes and said fines fraction particles in said entrained reaction zone for about 2 to about 5 seconds.

16. A process according to claim 15 introducing entraining gas to the lower portion of said entrained reaction zone.

17. A process according to claim 16 wherein said entraining gas principally comprises gas selected from the group consisting of hot flue gases, recycled product gases, steam, $CO_2$ rich gases, air, and mixtures thereof.

18. A process according to claim 16 wherein said entraining gas is preheated to temperatures up to about 2000° F. exterior to said reaction vessel.

19. A process according to claim 14 comprising introducing supplemental gas to the lower portion of said freeboard reaction zone.

20. A process according to claim 19 wherein said supplemental gas principally comprises gas selected from the group consisting of hot flue gases, recycled product gases, steam, $CO_2$ rich gases, air, and mixtures thereof, and said supplemental gas is preheated to temperatures up to about 2000° F. exterior to said reactor.

21. A process according to claim 14 comprising separating char solids from said gaseous products and passing said char solids to said fluidized bed.

22. A process according to claim 14 comprising maintaining said coarse fraction particles in said fluidized bed reaction zone for about 5 to about 60 minutes and said fines fraction particles in said entrained reaction zone for about 2 to about 5 seconds, introducing supplemental gas preheated to temperatures up to about 2000° F. to the lower portion of said freeboard reaction zone, and separating char solids from said gaseous products and passing said char solids to said fluidized bed.

* * * * *